US005933509A

United States Patent [19]

Wu

[11] Patent Number: 5,933,509

[45] Date of Patent: Aug. 3, 1999

[54] BAND PASS SPEAKER

[76] Inventor: George Wu, 1357 Kuehner Dr., Simi Valley, Calif. 93063

[21] Appl. No.: 08/844,703

[22] Filed: Apr. 18, 1997

[51] Int. Cl.[6] ..... H04R 25/00

[52] U.S. Cl. ..... 381/345; 381/87; 381/386; 181/199

[58] Field of Search ..... 381/337, 340, 381/341, 345, 352, 160, 182, 186, 87, 89, 332, 336; 181/153, 155, 152, 199

[56] References Cited

U.S. PATENT DOCUMENTS 5,637,840 6/1997 Kim ..... 181/155

*Primary Examiner*—Huyen Le
*Attorney, Agent, or Firm*—David and Raymond; Raymond Y. Chan

[57] ABSTRACT

A band pass speaker which can project tight clean bass with high quality sound, which is a speaker having a specially designed speaker box, including a first housing and a second housing. The first housing has a predetermined access opening on a front side and has an all around inner wall which provides an inner chamber with the predetermined access opening on the front side, at a back portion surface of the all around inner wall has a curvature, whereby the predetermined access opening is for receiving a second housing. The second housing has at least one sound generating unit mounted on a front side pointing forwardly, in which the second housing having an all around concealed inner wall providing a predetermined inner chamber, whereby at a front side edge of the front side of the second housing is for engaging into the access opening of the first housing leaving a predetermined output opening therebetween.

9 Claims, 3 Drawing Sheets

BAND PASS SPEAKER

FIELD OF THE PRESENT INVENTION

The present invention relates to a band pass speaker and more particularly to a sound projecting apparatus that provides focus and clean high quality sounds for homes, cars, entertainment theaters and etc. The present invention is a breakthrough in the new generation of tight and focused bass utilizing speaker system due to its ovation designed inner walls which guide all the sound waves generated by a sound projecting unit within an inner chamber and driving all the sound waves through and out a sound wave focusing pocket.

BACKGROUND OF THE PRESENT INVENTION

In today's world we know that technology is growing at a particularly fast rate, we can see it grow quickly as time goes by. Some of the fastest growing industries in the world today are the electronic industries, because the strength in computer science is leading our technological society into the future world.

The audio entertainment industries have been feeding all the consumers with great electronic sound producing apparatuses this past decade, and as a way of human nature, quality would so long until a new or better product emerge into the market. There are countless verities of audio system out in the market today, some are good quality electronics and some are bad, but the main concern should be on how good the best is. The reason that there are so many kinds of speaker designs is because there are many different kind of music lovers, and for a certain type of music we need a certain type of speaker to bring out the quality in the sounds.

Recently, band pass loudspeaker enclosure design in demand, especially so me of the sub woofer enclosures. The designer can manipulate the tuning frequency to trade for the desire bandwidth and its efficiency. Conventional band pass enclosure designs are usually constructed in shape of square or rectangular with four straight corners, in which the sound waves then pass through the duct in the shape of slot or circular. This conventional design has left high degree of sound waves trapped inside the enclosure both the front and the rear chamber, whereby trapped sound waves are known to reflect themselves inside the enclosure and work against each other including the driver itself The magnitude of these standing waves will increase especially when sound waves are trapped at the comers of the enclosure.

SUMMARY OF THE PRESENT INVENTION

The main object of the present invention is to provide a band pass speaker which can project tight clean bass with high quality sound when the speaker is set up with any type of conventional audio system.

Another object of the present invention is to provide a band pass speaker for upgrading of all the future audio system at homes, cars, movie theaters and etc..

Accordingly, the present invention provides a band pass speaker which can project tight clean bass with high quality sound, in which the present invention is a speaker having a specially designed speaker box, comprising a first housing and a second housing. The first housing having a predetermined access opening on a front side and has an all around inner wall which provides an inner chamber with the predetermined access opening on the front side, at a back portion surface of the all around inner wall has a curvature, whereby the predetermined access opening is for receiving a second housing. The second housing having at least one sound generating unit mounted on a front side pointing forwardly, in which the second housing having an all around concealed inner wall providing a predetermined inner chamber, whereby at a front side edge of the front side of the second housing is for engaging into the access opening of the first housing leaving a predetermined output opening therebetween.

DETAILED DESCRIPTION OF THE PREFERRED EMBODIMENT

Referring to FIGS. 1 to 4 of the drawings, a preferred embodiment of the present invention is illustrated. A band pass speaker 10 for projecting a tight and clean high quality bass sound, comprises a first housing 100 and a second housing 200.

Figure 1:
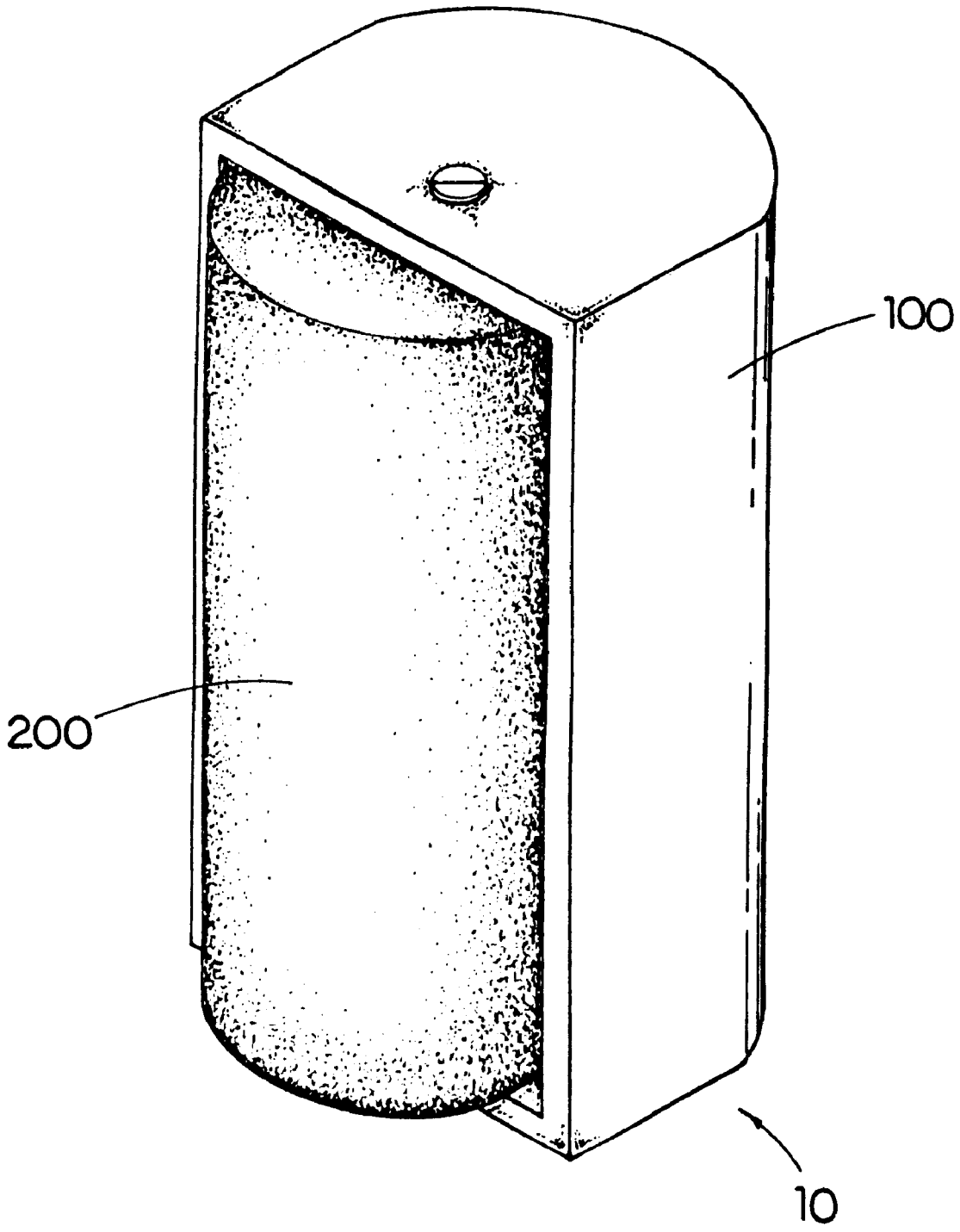
FIG. 1 is a perspective view of a band pass speaker of a first preferred embodiment according to the present invention.
Figure 2:
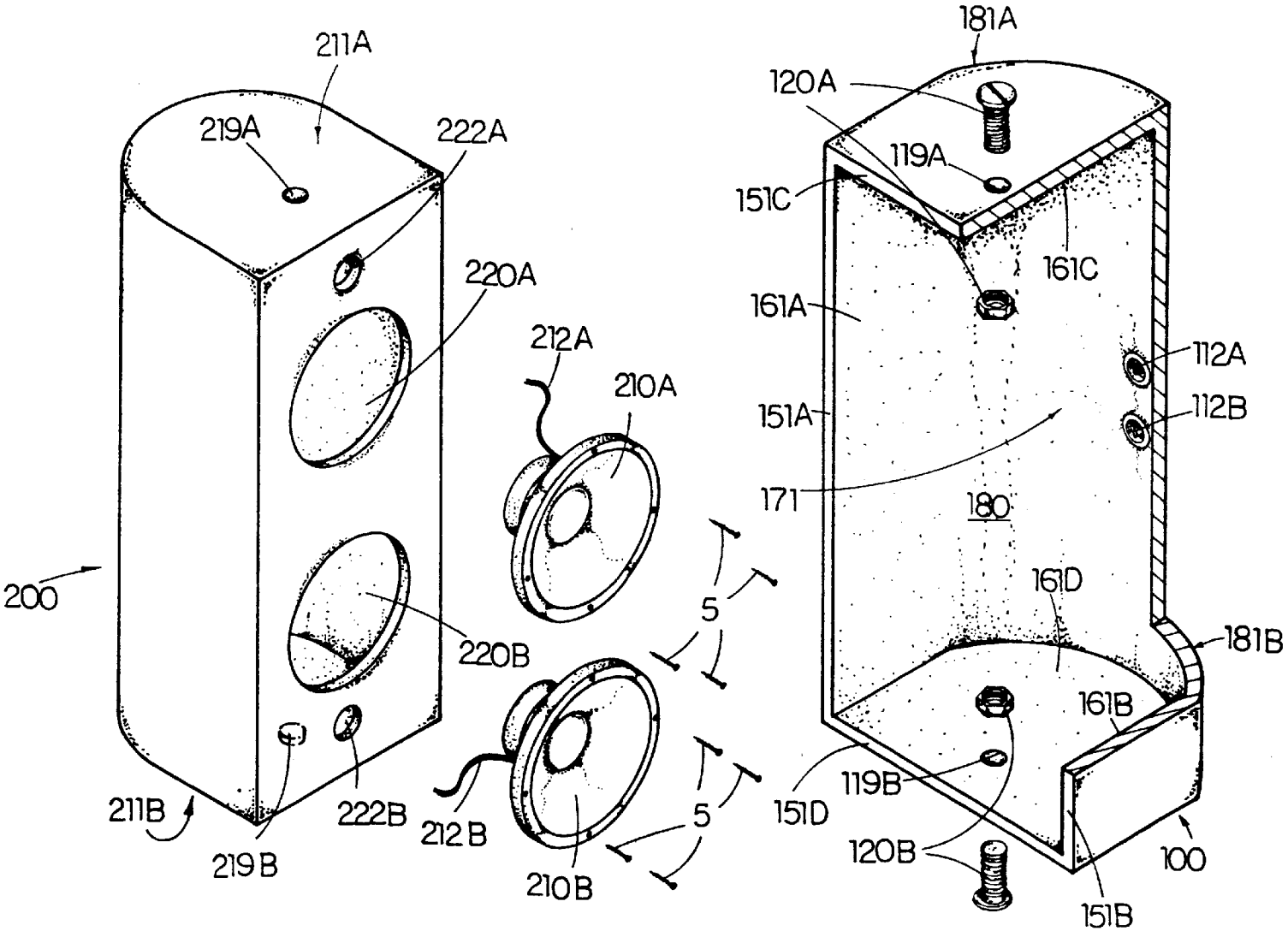
FIG. 2 is an exploded perspective view of a band pass speaker of the above first preferred embodiment according to the present invention.

In accordance with this preferred embodiment, as shown in FIG. 2, at a front side of the first housing 100 having an access opening 111 with rectangular diameter, in which the access opening 111 is determined by a right opening edge 151A, a left opening edge 151B, a top opening edge 151C and a bottom opening edge 151D. At the right opening edge 151A of the access opening 111 having a right inner wall 161A continuing toward an inner back wall 171, whereby the left opening edge 151B of the access opening 111 having a right inner wall 161B continuing toward an inner back wall 171. The right inner wall 161A is connected continuously to the right side of the inner back wall 171 by a first curved vertical wall 181A to provide a smooth cornering within an inner chamber, as so as the left inner wall 161B is connected continuously to the left side of the inner back wall 171 by a second curved vertical wall 181B to provide a smooth cornering wall surface within the inner chamber of the first housing. At the center portion of the inner back wall 171 having two input outlets 112A and 112B mounted thereon respectively for receiving any type of conventional output speaker wire.

At the top opening edge 151C having a top wall 161C continuing toward and connecting with the top side of the right inner wall 161A, the first curved vertical wall 181A, the inner back wall 171, the second curved vertical wall 181B, and the left inner wall 161B, as so as at the bottom opening edge 151D having a bottom wall 161D continuing toward and connecting with the bottom side of the right inner wall 161A, the first curved vertical wall 181A, the inner back wall 171, the second curved vertical wall 181B, and the left inner wall 161B providing the inner chamber 180 of the first housing 100. At the middle portion of the top wall 161C and the bottom wall 161D, having a bolt size hole 119A, and 119B punctured therethrough respectively for nut and bolt lock 120A and 120B between the first housing and the second housing.

At a center portion of the top wall 211A and the bottom wall 211B of the second housing 200, a screw hole 219A and 219B is punctured therethrough respectively for receiving the nut and bolt lock 120A and 120B. At a front side of the second housing having two sub woofers 210A and 210B with attached input wires 212A and 212B mounted on to front board by lock screws 5 in a vertical center manner respectively. Two wire access holes 222A and 222B are also punctured in a vertical center manner respectively on the front board of the second housing 200. The rear portion of the second housing 200 is a half arc conceal chamber which help provide smooth sound wave traveling within the chamber.

Figure 3:
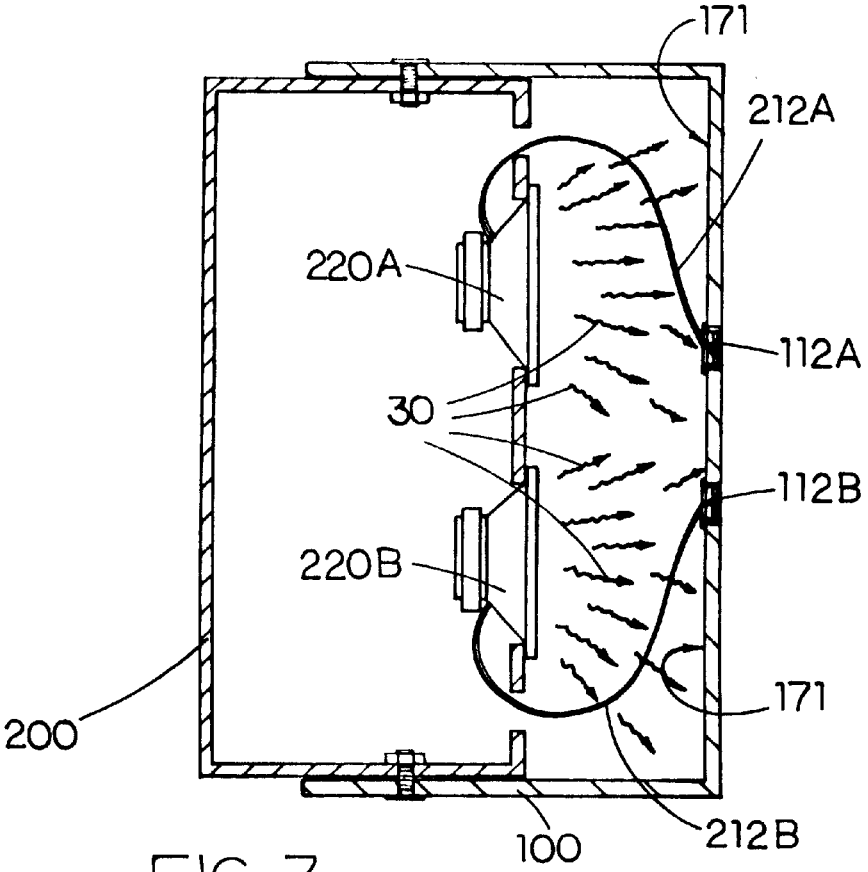
FIG. 3 is a side sectional view of a band pass speaker of the above first preferred embodiment according to the present invention.
Figure 4:
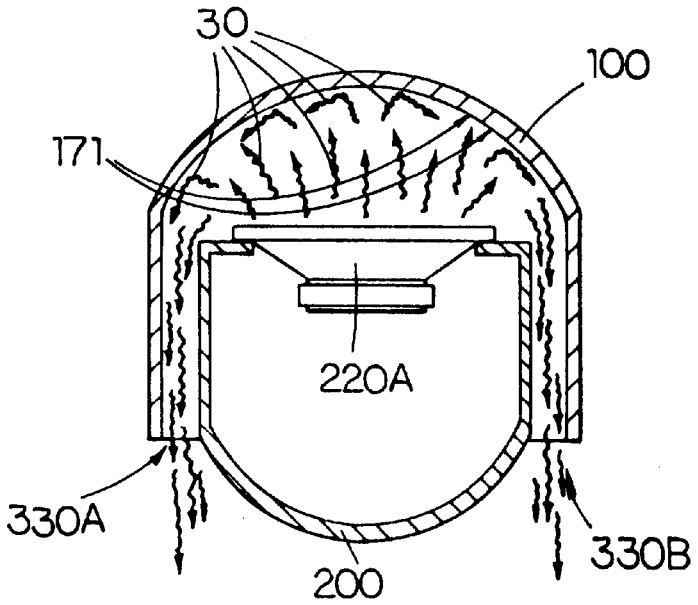
FIG. 4 is a top sectional view of a band pass speaker of the above first preferred embodiment according to the present invention.

As shown in FIGS. 3 and 4 of the drawings, showing the first housing 100 receiving the second housing 200 and the second housing 200 is lock in position by the nut and bolt locks 120A and 120B. Once the input wires 212A and 212B is connected to the input outlets 112A and 112B, the audio inputs will be projected through the sub woofers 210A and 210B, and as the sound waves 30 travels forward directing into inner back wall 171, the sound waves 30 will be guided along the internal walls of the inner chamber 180 and focusing out through the side vertical pockets 330A and 330B.

I claim:

1. A band pass speaker, comprising;

a first housing having a predetermined access opening on a front side, in which said first housing has an all around inner wall providing an inner chamber with said predetermined access opening on said front side, at a back portion surface of said all around inner wall has a curvature, whereby said predetermined access opening is for receiving a second housing; and said second housing having at least one sound generating unit mounted on a front side pointing forwardly, in which said second housing having an all around concealed inner wall providing a predetermined inner chamber, whereby at a front side edge of said front side of said second housing is to engage into said access opening of said first housing leaving a predetermined output opening therebetween;

wherein at a right side edge of said access opening of said first housing has a right vertical wall continuing toward a right side of an inner back wall, as so as at a left side edge of said access opening of said first housing has a left vertical wall continuing toward a left side of said inner back wall, whereby said right vertical wall and said right side of said inner back wall is connected by a first continuous vertical curvature inner wall, as so as said left vertical wall and said left side of said inner back wall is connected by a second continuous vertical curvature inner wall, in which at a top side of said first housing has a top inner wall continuing from a top side edge of said predetermined access opening toward and connection with a top side edge of said right vertical wall, a top side edge of said first continuous vertical curvature inner wall, a top side edge of said inner back wall, a top side edge of said second continuous vertical curvature inner wall, and a top side edge of said left vertical wall, whereby at a bottom side of said first housing has a bottom inner wall continuing from a bottom side edge of said predetermined access opening toward and connection with a bottom side edge of said right vertical wall, a bottom side edge of said first continuous vertical curvature inner wall, a bottom side edge of said inner back wall, a bottom side edge of said second continuous vertical curvature inner wall, and a bottom side edge of said left vertical wall which provide said inner chamber with said predetermined access opening on said front side of said first housing;

wherein said top inner wall has a first locking means, as so as said bottom inner wall has a second locking means in which said first and said second locking means are adapted for holding said second housing in position, whereby said inner back wall having at least one electronic input outlet for adaptation with input speaker wire.

2. A band pass speaker, as recited in claim 1, in which on said front side of said second housing having a predetermined speaker wire access opening for the wire from said sound generating unit to access through and connecting with said electronic input outlet of said first housing.

3. A band pass speaker, as recited in claim 1, in which each of said first locking means and said second locking means is a nut and bolt lock, whereby on a top wall of said second housing having a hole punctured therethrough for receiving said nut and bolt lock during engagement with said first housing.

4. A band pass speaker, comprising;

a first housing having a predetermined access opening on a front side, in which said first housing has an all around inner wall providing an inner chamber with said predetermined access opening on said front side, at a back portion surface of said all around inner wall has a curvature, whereby said predetermined access opening which has a predetermined vertical rectangular diameter is for receiving a second housing; and said second housing having at least one sound generating unit mounted on a front side pointing forwardly, in which said second housing having an all around concealed inner wall providing a predetermined inner chamber, whereby at a front side edge of said front side of said second housing is to engage into said access opening of said first housing leaving a predetermined output opening therebetween;

wherein at a right side edge of said access opening of said first housing has a right vertical wall continuing toward a right side of an inner back wall, as so as at a left side edge of said access opening of said first housing has a left vertical wall continuing toward a left side of said inner back wall, whereby said right vertical wall and said right side of said inner back wall is connected by a first continuous vertical curvature inner wall, as so as said left vertical wall and said left side of said inner back wall is connected by a second continuous vertical curvature inner wall, in which at a top side of said first housing has a top inner wall continuing from a top side edge of said predetermined access opening toward and connection with a top side edge of said right vertical wall, a top side edge of said first continuous vertical curvature inner wall, a top side edge of said inner back wall, a top side edge of said second continuous vertical curvature inner wall, and a top side edge of said left vertical wall, whereby at a bottom side of said first housing has a bottom inner wall continuing from a bottom side edge of said predetermined access opening toward and connection with a bottom side edge of said right vertical wall, a bottom side edge of said first continuous vertical curvature inner wall, a bottom side edge of said inner back wall, a bottom side edge of said second continuous vertical curvature inner wall, and a bottom side edge of said left vertical wall which provide said inner chamber with said predetermined access opening on said front side of said first housing;

wherein said top inner wall has a first locking means, as so as said bottom inner wall has a second locking means in which said first and said second locking means are adapted for holding said second housing in position, whereby said inner back wall having at least one electronic input outlet for adaptation with input speaker wire.

5. A band pass speaker, as recited in claim 4, in which on said front side of said second housing having a predetermined speaker wire access opening for the wire from said sound generating unit to access through and connecting with said electronic input outlet of said first housing.

6. A band pass speaker, as recited in claim 5, in which each of said first locking means and said second locking means is a nut and bolt lock, whereby on a top wall of said second housing having a hole punctured therethrough for receiving said nut and bolt lock during engagement with said first housing.

7. A band pass speaker, comprising;

a first housing having a predetermined access opening on a front side, in which said first housing has an all around inner wall providing an inner chamber with said predetermined access opening on said front side, at a back portion surface of said all around inner wall has a curvature, whereby said predetermined access opening which has a predetermined horizontal rectangular diameter is for receiving a second housing; and said second housing having at least one sound generating unit mounted on a front side pointing forwardly, in which said second housing having an all around concealed inner wall providing a predetermined inner chamber, whereby at a front side edge of said front side of said second housing is to engage into said access opening of said first housing leaving a predetermined output opening therebetween;

wherein at a right side edge of said access opening of said first housing has a right vertical wall continuing toward a right side of an inner back wall, as so as at a left side edge of said access opening of said first housing has a left vertical wall continuing toward a left side of said inner back wall, whereby said right vertical wall and said right side of said inner back wall is connected by a first continuous vertical curvature inner wall, as so as said left vertical wall and said left side of said inner back wall is connected by a second continuous vertical curvature inner wall, in which at a top side of said first housing has a top inner wall continuing from a top side edge of said predetermined access opening toward and connection with a top side edge of said right vertical wall, a top side edge of said first continuous vertical curvature inner wall, a top side edge of said inner back wall, a top side edge of said second continuous vertical curvature inner wall, and a top side edge of said left vertical wall, whereby at a bottom side of said first housing has a bottom inner wall continuing from a bottom side edge of said predetermined access opening toward and connection with a bottom side edge of said right vertical wall, a bottom side edge of said first continuous vertical curvature inner wall, a bottom side edge of said inner back wall, a bottom side edge of said second continuous vertical curvature inner wall, and a bottom side edge of said left vertical wall which provide said inner chamber with said predetermined access opening on said front side of said first housing;

wherein said top inner wall has a first locking means, as so as said bottom inner wall has a second locking means, in which said first and said second locking means are adapted for holding said second housing in position, whereby said inner back wall having at least one electronic input outlet for adaptation with input speaker wire.

8. A band pass speaker, as recited in claim 7, in which on said front side of said second housing having a predetermined speaker wire access opening for the wire from said sound generating unit to access through and connecting with said electronic input outlet of said first housing.

9. A band pass speaker, as recited in claim 8, in which each of said first locking means and said second locking means is a nut and bolt lock, whereby on a top wall of said second housing having a hole punctured therethrough for receiving said nut and bolt lock during engagement with said first housing.

* * * * *